US008166497B2

(12) United States Patent
Mears

(10) Patent No.: US 8,166,497 B2
(45) Date of Patent: Apr. 24, 2012

(54) METHODS AND APPARATUS TO COLLECT MEDIA MONITORING INFORMATION

(75) Inventor: Paul M. Mears, Safety Harbor, FL (US)

(73) Assignee: The Nielsen Company (US) , LLC, Schaumburg, IL (US)

( * ) Notice: Subject to any disclaimer, the term of this patent is extended or adjusted under 35 U.S.C. 154(b) by 838 days.

(21) Appl. No.: 12/035,974

(22) Filed: Feb. 22, 2008

(65) Prior Publication Data

US 2009/0089823 A1 Apr. 2, 2009

Related U.S. Application Data

(60) Provisional application No. 60/976,201, filed on Sep. 28, 2007.

(51) Int. Cl.
*H04H 60/33* (2008.01)

(52) U.S. Cl. ..... 725/9

(58) Field of Classification Search ..... None
See application file for complete search history.

(56) References Cited

U.S. PATENT DOCUMENTS

| | | | | |
|---|---|---|---|---|
| 4,025,851 | A * | 5/1977 | Haselwood et al. | 725/22 |
| 4,603,232 | A | 7/1986 | Kurland et al. | |
| 4,696,034 | A * | 9/1987 | Wiedemer | 380/230 |
| 4,912,552 | A | 3/1990 | Allison, III et al. | |
| 5,220,522 | A | 6/1993 | Wilson et al. | |
| 5,768,680 | A | 6/1998 | Thomas | |
| 5,978,833 | A * | 11/1999 | Pashley et al. | 709/200 |
| 6,124,877 | A * | 9/2000 | Schmidt | 725/10 |
| 6,202,210 | B1 | 3/2001 | Ludtke | |
| 6,483,986 | B1 | 11/2002 | Krapf | |
| 6,751,402 | B1 | 6/2004 | Elliott et al. | |
| 7,027,716 | B1 | 4/2006 | Boyle et al. | |
| 7,222,071 | B2 | 5/2007 | Neuhauser et al. | |
| 7,239,981 | B2 | 7/2007 | Kolessar et al. | |
| 7,590,992 | B2 * | 9/2009 | Koplar et al. | 725/23 |
| 2002/0078469 | A1 | 6/2002 | Kano | |
| 2002/0194219 | A1 * | 12/2002 | Bradley et al. | 707/506 |
| 2003/0126593 | A1 | 7/2003 | Mault | |
| 2004/0049787 | A1 * | 3/2004 | Maissel et al. | 725/46 |
| 2004/0187164 | A1 * | 9/2004 | Kandasamy et al. | 725/132 |

(Continued)

FOREIGN PATENT DOCUMENTS

| | | |
|---|---|---|
| EP | 0598398 | 5/1994 |

(Continued)

OTHER PUBLICATIONS

International Searching Authority, "PCT International Search Report and PCT Written Opinion," from the International Searching Authority, issued Oct. 7, 2008, in connection with international application No. PCT/US2008/056641 (16 Pages).

(Continued)

*Primary Examiner* — Brian Pendleton
*Assistant Examiner* — Jason Lin
(74) *Attorney, Agent, or Firm* — Hanley, Flight & Zimmerman, LLC

(57) ABSTRACT

Example methods, apparatus, and articles of manufacture to collect metering information associated with media presented media presentation devices are disclosed. A disclosed example system for collecting metering information includes a media meter to generate media monitoring information in response to media presented by a media presentation device. The example system also includes a peripheral memory device removably couplable by an audience member to the media meter to receive the media monitoring information.

31 Claims, 7 Drawing Sheets

U.S. PATENT DOCUMENTS

| | | | | |
|---|---|---|---|---|
| 2005/0216509 | A1 | 9/2005 | Kolessar et al. | |
| 2006/0026653 | A1* | 2/2006 | Matsunami | 725/81 |
| 2006/0136173 | A1 | 6/2006 | Case, Jr. et al. | |
| 2006/0294552 | A1* | 12/2006 | Swanson et al. | 725/80 |
| 2007/0180485 | A1* | 8/2007 | Dua | 725/114 |
| 2007/0226760 | A1 | 9/2007 | Neuhauser et al. | |
| 2008/0115183 | A1* | 5/2008 | Zato et al. | 725/110 |
| 2008/0148309 | A1* | 6/2008 | Wilcox et al. | 725/14 |

FOREIGN PATENT DOCUMENTS

| | | |
|---|---|---|
| EP | 0598682 | 5/1994 |
| EP | 1207639 | 5/2002 |
| EP | 1418692 | 5/2004 |
| FR | 2652430 | 9/1989 |
| GB | 2143354 | 2/1985 |

OTHER PUBLICATIONS

International Preliminary Report on Patentability, issued by the International Bureau on Apr. 8, 2010, in connection with International Application No. PCT/US2008/056641, 10 pages.

* cited by examiner

METHODS AND APPARATUS TO COLLECT MEDIA MONITORING INFORMATION

This patent claims priority to U.S. Provisional Patent Application Ser. No. 60/976,201, entitled "Methods and Apparatus to Collect Media Monitoring Information," filed on Sep. 28, 2007 which is hereby incorporated by reference in its entirety.

FIELD OF THE DISCLOSURE

The present disclosure relates generally to media monitoring and, more particularly, to methods and apparatus to collect media monitoring information.

BACKGROUND

Consuming media presentations generally involves listening to audio information and/or viewing video information such as, for example, radio programs, music, television programs, movies, still images, etc. Media-centric companies such as, for example, advertising companies, broadcasting networks, etc. are often interested in the viewing and listening interests of their audience to better allocate their advertising expenditures and better market their products.

A known technique often used to measure the exposure of audience members to media involves installing metering equipment within a household connected to one or more televisions and/or stereos throughout the household. When members of the household watch television or other video media content (e.g., digital video disks, video cassette recorders, personal video recorders, etc.) and/or listen to radio programming or audio from compact discs (CD's), tapes, etc., the metering equipment collects metering information such as, for example, video or audio signatures (e.g., samples of the monitored signals or proxies representative of such samples), identification codes (e.g., codes ancillary to the program content inserted into the program for the purpose of audience measurement), time/date stamps, user identities, demographic characteristics, etc.

In some cases, to extract the media monitoring data or information from the metering equipment, the metering equipment must be removed from the audience member's house by field personnel or otherwise shipped to a central processing facility. Damage to the metering equipment and/or the media monitoring information may occur during the removal and/or shipment. In addition, the equipment or information may otherwise be lost.

Furthermore, requiring the metering equipment to be removed from a household to extract the media monitoring data prevents an audience measurement company from obtaining further media monitoring information from a willing participate. This also adds costs associated with the removal of the media monitoring equipment, shipment, processing, securing of additional audience members, and reshipment of the media monitoring equipment to the additional audience members.

DETAILED DESCRIPTION

Figure 1:
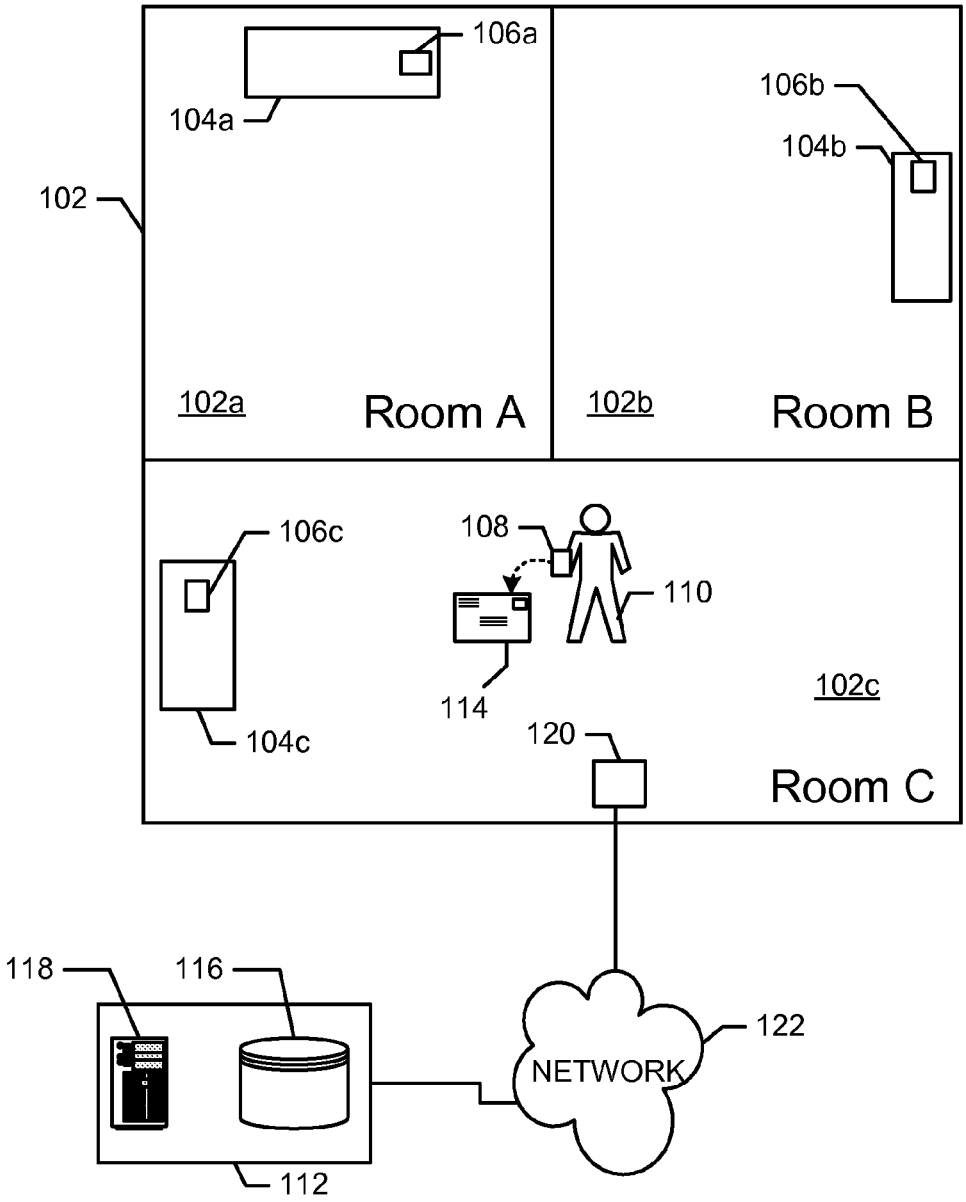
FIG. 1 illustrates an example area in which media monitoring information may be collected.

Although the following discloses example apparatus and systems including, among other components, software executed on hardware, it should be noted that such apparatus and systems are merely illustrative and should not be considered as limiting. For example, it is contemplated that any or all of these hardware and software components could be embodied exclusively in hardware, exclusively in software, or in any combination of hardware and software. Accordingly, while the following describes example methods, apparatus, and systems, persons having ordinary skill in the art will readily appreciate that the examples provided are not the only way to implement such methods, apparatus, and systems.

In general, the example methods and apparatus described herein may be used to collect media monitoring information generated by media meters located at audience member households. As described below, a household participating in a market research program to meter video and/or audio presentations presented and/or consumed in that household is provided with a plurality of media meters, each of which is located proximate to a respective media presentation device (e.g., a television, a stereo, a computer, etc.). The media meters are configured to generate and store media monitoring information based on media presented by the media presentation devices and detected by the media meters. To analyze the media monitoring information, the example methods and apparatus described herein can be used to send the metering information to a collection facility using a peripheral memory device that can be removably communicatively coupled to each media meter in a household to transfer the media monitoring information from each of the meters to the peripheral memory device. In this way, an audience member of the household can ship the peripheral memory device storing the collected media monitoring information from all of the media meters in the household to the collection facility. Unlike traditional methods that require shipping every media meter (i.e., the entire meter) of the household to the collection facility to enable the collection facility to extract the media monitoring information, the example methods and apparatus described herein enable audience member households to keep the media meters installed and instead ship only the peripheral memory device with the media monitoring information from all of the meters in the household.

Using a single peripheral memory device per audience member household to collect media monitoring information is advantageous over known methods involving shipping entire meters back to a collection facility. In particular, not having to ship the entire meter back to a collection facility substantially reduces the amount of recruiting that a market research entity needs to do to recruit panel households. In other words, meters can remain installed in audience member households longer for relatively longer durations (e.g., two years instead of one month) and the example peripheral memory devices described herein can be used to send media monitoring information to the collection facility. In addition, the example methods and apparatus described herein reduce the likelihood of damage to the meters during transportation by requiring meters to be shipped less often. Also, the amount of hardware handling and processing at the collection facility is significantly reduced by only having to receive and process (e.g., download media monitoring information from) one peripheral memory device from each audience member household for each collection cycle instead of having to receive and process a plurality of media meters from each audience member household. The likelihood of failing to download data from a metering device at the collection facility is also reduced as is the likelihood of confusing or overlooking peripheral memory devices corresponding to different metering devices in a household.

To ensure media monitoring information is recoverable in the event that the memory contents of a peripheral memory device become corrupt or otherwise invalid during a shipping process or at any other time after the media monitoring information is transferred to the peripheral memory device, the example methods and apparatus described herein can be used to also store backup or archived copies of media monitoring information at the audience member households after the media monitoring information is stored in the peripheral memory device. As a results, should data become corrupt or unrecoverable from a peripheral memory device received at the collection facility, the collection facility can request that a corresponding audience member send a copy of the backup or archived copy of the media monitoring information stored at the audience member household.

In some example implementations, the example methods and apparatus described herein can be used to communicate media monitoring information from audience member households to a collection facility via the Internet. For example, an audience member household may be provided with a data cable or a communication cable to communicatively couple the media meters in that household to a computer connected to the Internet. The computer can be provided with software to retrieve the media monitoring information from the media meters and communicate the information to the collection facility. Additionally or alternatively, an audience member household may be provided with a peripheral memory device reader connected to a computer having an Internet connection. In this manner, an audience member of the household can collect the media monitoring information from every media meter of the household on a peripheral memory device. The audience member can subsequently couple the peripheral memory device to the computer via the peripheral memory device reader to upload the media monitoring information to the collection facility. In some example implementations, an audience member of the household may be required to navigate to a web page of a market research entity to communicate the media monitoring information to the collection facility via the web page interface.

Turning to FIG. 1, an example audience member household 102 is shown in which media monitoring information may be collected. The household 102 includes a plurality of media presentation areas 102*a-c* (i.e., rooms A-C 102*a-c*), each of which includes a respective media presentation device 104*a-c*. In the illustrated example, the media presentation devices 104*a-c* are televisions. However, in other example implementations, each of the media presentation devices 104*a-c* can be any other type of device including, for example, a stereo, a computer, etc. Each of the rooms 102*a-c* includes a respective one of a plurality of media meters 106*a-c*, each of which is located proximate to a respective one of the media presentation devices 104*a-c*. In the illustrated example, the media meters 106*a-c* are configured to generate and store media monitoring information by detecting audio emissions presented by the media presentation devices 104*a-c* via respective speakers, generating audio signatures representative of the detected audio emissions, and storing the signatures in association with respective timestamps and media meter identifications. Other types of media monitoring (e.g., channel detection, audio code or watermark detection, video code or watermark detection, video signature collection, etc.) may additionally or alternatively be employed.

To transfer the media monitoring information, the household is provided with a peripheral memory device 108 that can be removably communicatively coupled to any of the media meters 106*a-c*. In the illustrated example, an audience member 110 is instructed by a market research entity to send the media monitoring information from the media meters 106*a-c* to a collection facility 112 of the market research entity once per every data collection period (e.g., once per month, once every two months, etc.). The audience member 110 can carry the peripheral memory device 108 to each of the media meters 106*a-c* and copy the media monitoring information from the media meters 106*a-c* to the peripheral memory device 108. After copying the media monitoring information from all of the media meters 106*a-c* in the household 102, the audience member 110 can place the peripheral memory device 108 in a shipping package 114 (e.g., an envelope, a box, etc.) and ship the peripheral memory device 108 to the collection facility 112. At the collection facility 112, the media monitoring information can be transferred to a data store 116 (e.g., a database or some other data structure) for subsequent analysis by a processor system 118. Although the methods and apparatus are described herein in connection with using a single peripheral memory device, in alternative example implementations two or more peripheral memory devices may be used, each of which may be used to collect media monitoring information from a respective media meter in the household 102. In such example implementations, all of the peripheral memory devices can be shipped to the collection facility 112 in the same or separate packages.

In the illustrated example, the household 102 includes a computer 120 connected to the collection facility 112 via a communication network 122 (e.g., the Internet). In some example implementations, the audience member 110 may be instructed to transfer the media metering data to the collection facility 112 via the network 122 instead of using the peripheral memory device 108 to ship the media monitoring information to the collection facility 112. For example, the media meters 106*a-c* may be communicatively coupled to the computer 120 via a data cable. Alternatively, after the audience member 110 transfers the media monitoring information from all of the media meters 106*a-c* to the peripheral memory device 108, the peripheral memory device 108 may be communicatively coupled to the computer 120 to transfer the media monitoring information to the collection facility 112.

Figure 2:
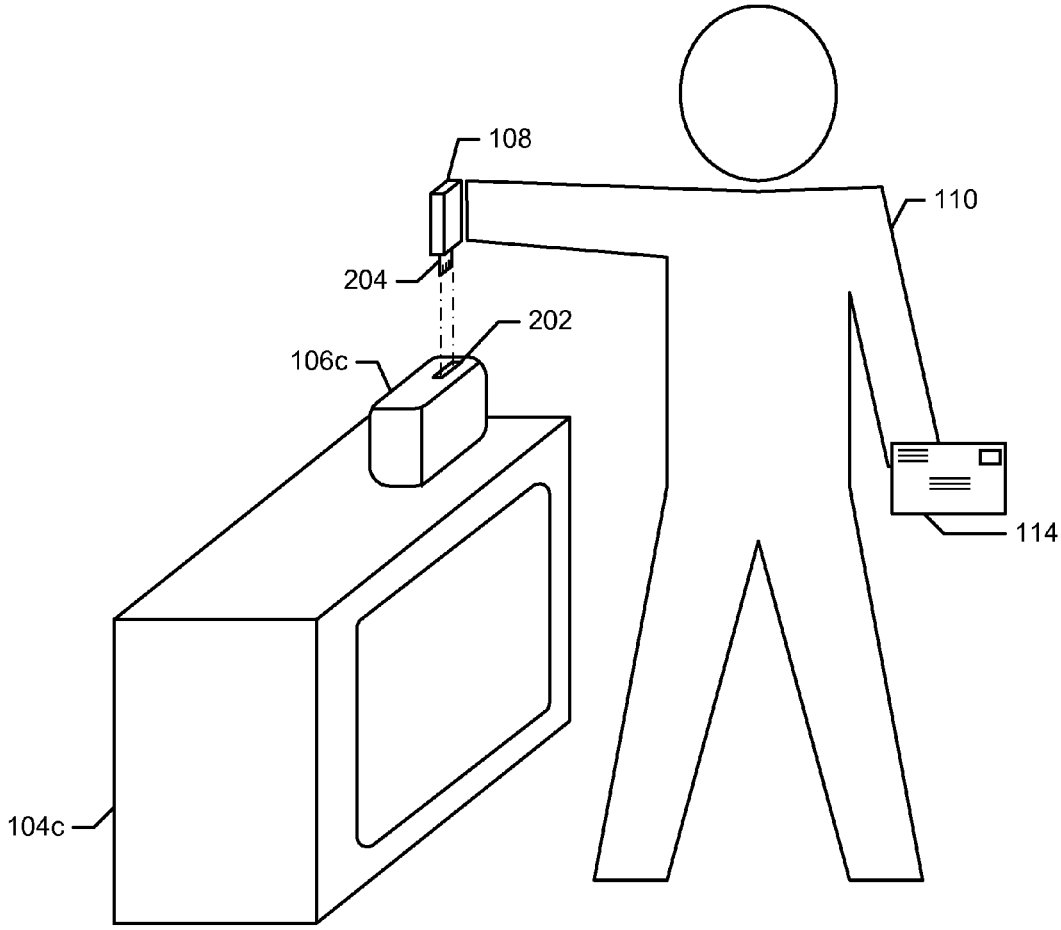
FIG. 2 illustrates an example media meter having a physical data interface to receive a removably couplable peripheral memory device.

FIG. 2 illustrates the example media meter 106*c* of FIG. 1 having a physical data interface 202 to receive a physical data interface 204 of the removably coupleable peripheral memory device 108 of FIG. 1. As shown, the audience member 110 can removably couple the peripheral memory device 108 to the media meter 106*c* via the data interfaces 202 and 204. In the illustrated example, the physical data interfaces 202 and 204 are implemented using memory card interface standards such as, for example, a secure digital (SD) memory card interface, a multimedia card (MMC) interface, etc. In other example implementations, the physical data interfaces 202 and 204 may be implemented using other types of standards (e.g., a universal serial bus (USB) interface, an IEEE 1394 (FireWire) interface, etc.).

Figure 3:
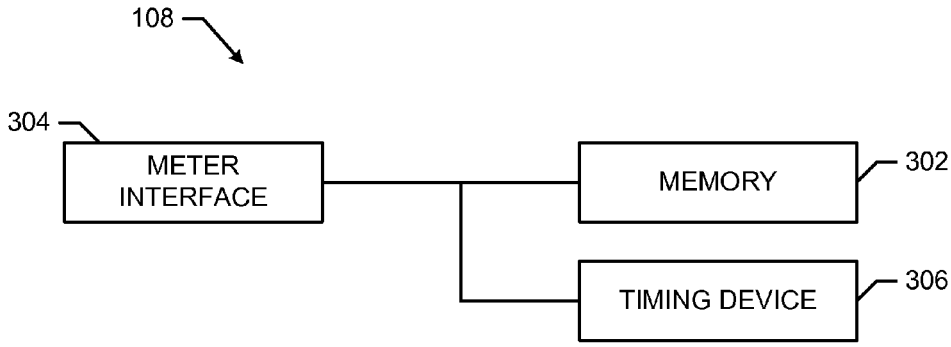
FIG. 3 is a block diagram of the example peripheral memory device of FIGS. 1 and 2.

FIG. 3 is a block diagram of the example peripheral memory device 108 of FIGS. 1 and 2. To store media monitoring information, the peripheral memory device 108 is provided with a memory 302. The memory 302 is configured to store media monitoring information from each of the media meters 106*a-c* of FIG. 1. The media monitoring information from each of the media meters 106*a-c* includes audio signatures generated and/or audio codes collected by that meter stored in association with respective timestamps indicative of when the signatures and/or codes were obtained and a meter identifier of that meter. Of course, the metering function can vary and is dependent on the metering methodology employed To communicatively couple the peripheral memory device 108 to the media meters 106*a-c,* the peripheral memory interface 108 is provided with a meter interface 304. The meter interface 304 is communicatively coupled to the physical data interface 204 of FIG. 2 and includes the software and/or hardware to implement a memory interface communication protocol to receive data from the media meters 106*a-c.*

To synchronize internal clocks of the media meters 106*a-c* used to generate timestamps for the collected media monitoring information, the peripheral memory device 108 is provided with a timing device 306. Clock devices (e.g., internal clocks of the media meters 106*a-c*) typically have an amount of drift that causes the clock devices to represent inaccurate time values over time. The timing device 306 can be resynchronized to an accurate global standard time keeper or national standard time keeper (e.g., an atomic clock, a time provided by the United States National Institute of Standards and Technology, etc.) when the peripheral memory device 108 is at the collection facility 112. Each time the peripheral memory device 108 is connected to a meter (e.g., one of the media meters 106*a-c*), in addition to receiving the media monitoring information from the meter 106*a-c,* the peripheral memory device 108 can resynchronize the clock of the media meter 106*a-c* based on the time of the timing device 306 to ensure that the meter 106*a-c* generates accurate timestamps. This synchronization process ensures that the timestamps generated by the media meters 106*a-c* accurately coincide with broadcast times of television and/or radio programs. The timing device 306 may be implemented using a clock (e.g., a real-time clock), a timer, a counter, or any combination thereof.

By using accurate timestamps, it is relatively easier to match the audio signatures generated by the media meters 106*a-c* with corresponding reference signatures corresponding to broadcast programs and stored at the collection facility 112. For example, if a timestamp of a signature indicates that the signature was generated at 8:01:30 AM, but there is some speculation that the timestamp is inaccurate by one minute, the collection facility 112 must search reference signatures of broadcast programs lying within a span of two minutes, which is the total time window of 8:01:30 AM, +/− one minute. However, if the timestamp is assured to be accurate to fifteen seconds, then the collection facility 112 can find a reference signature matching the generated audio signature by searching data corresponding to a smaller window of time of thirty seconds, which is the total time window of 8:01:30 AM, +/− fifteen seconds.

Figure 4:
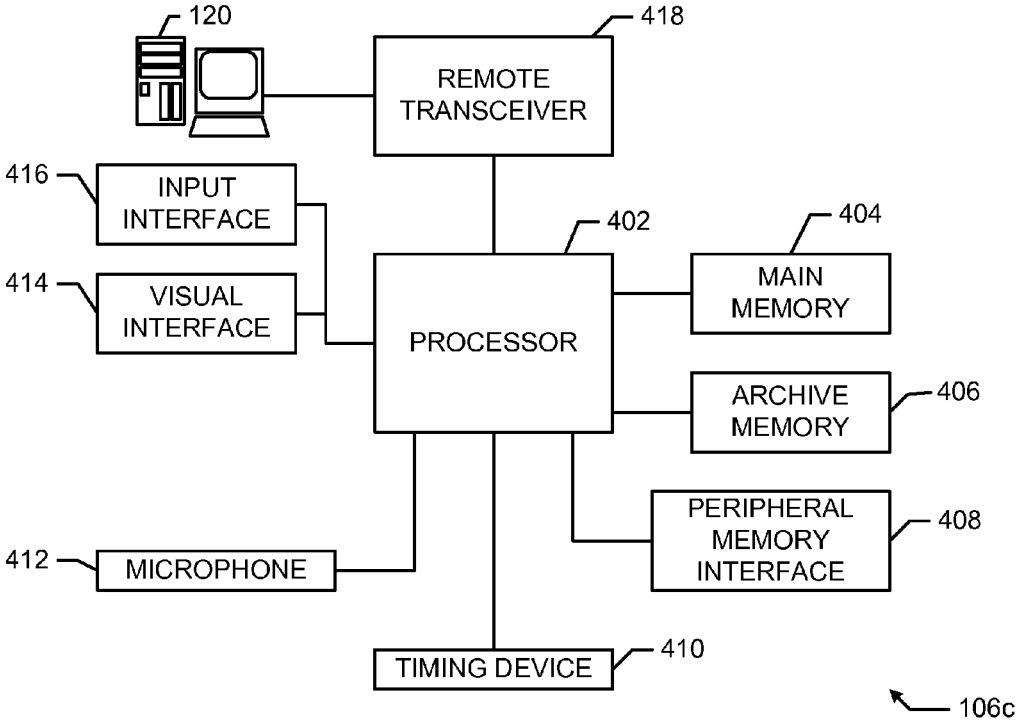
FIG. 4 is a block diagram of the example media meter of FIGS. 1 and 2.

FIG. 4 is a block diagram of any of the example media meters 106*a-c* of FIGS. 1 and 2. For ease of reference, the meter will be referred to as the media meter 106*c,* it being understood that all of the media meters 106*a-c* may be identical. The example media meter 106*c* includes a processor 402, a main memory 404, an archive memory 406, a peripheral memory interface 408, a timing device 410, a microphone 412, a visual interface 414, an input interface 416, and a remote transceiver 418, all of which may be communicatively coupled as shown.

The processor 402 may be used to control and perform one or more operations or features of the media meter 106*c,* and may be implemented using any suitable processor, such as any general purpose processor, digital signal processor, or any combination thereof. For example, the processor 402 may be configured to generate audio signatures and generate media monitoring information by storing the audio signatures in the main memory 404 in association with respective timestamps generated by the timing device 410 and an identification of the media meter 106*c.* The processor 402 may also be configured to control the copying of media monitoring information to the peripheral memory device 108 and to archive media monitoring information in an archive memory 406 from a previous or one or more prior data collection periods.

The timing device 410 may be implemented using a clock (e.g., a real-time clock) and may be used by the processor 402 to generate a timestamp for each audio signature to indicate the time of day at which that signature was generated. As discussed above, in connection with FIG. 3, the timing device 306 of the peripheral memory device 108 can be used to synchronize the timing device 410 of the media meter 106*c* with a standard time each time the peripheral memory device 108 is connected to the media meter 106*c.* Although the timing device 410 is shown separate from the processor 402, the timing device 410 may be integrated with the processor 402.

The microphone 412 may be used to detect and receive audio emissions associated with media presented by the media delivery device 104*c* (FIGS. 1 and 2). In this manner, the processor 402 can generate audio signatures based on and/or collect audio codes from audio emitted by the media presentation device 104*c.* In some example implementations, the processor 402 can be configured to additionally or alternatively extract and log audio codes from the received audio emissions and the codes can subsequently be analyzed to determine the programs to which an audience member was likely exposed.

The visual interface 414 may be used to convey information to the audience members of the household 102. For example, the visual interface 414 may be a text-based display or indicator lights to indicate operational status (e.g., ready to transfer data, metering mode enabled, error messages, etc.). The input interface 416 can be used to receive commands from an audience member. For example, the input interface 416 may include a 'data transfer' button that initiates a data transfer of information from the media meter 106*c* to the peripheral memory device 108 when the audience member 110 depresses the button.

In some example implementations, the media meter 106*c* can be provided with the remote transceiver 418 to communicatively couple the media meter 106*c* to the household computer 120 to upload media monitoring information to the collection facility 112 via, for example, the Internet or other communication medium. In some example implementations, the remote transceiver 418 can be omitted and the media meter 106*c* can be communicatively coupled to the household computer 120 via the peripheral memory interface 408 via a data cable.

Figure 5A:
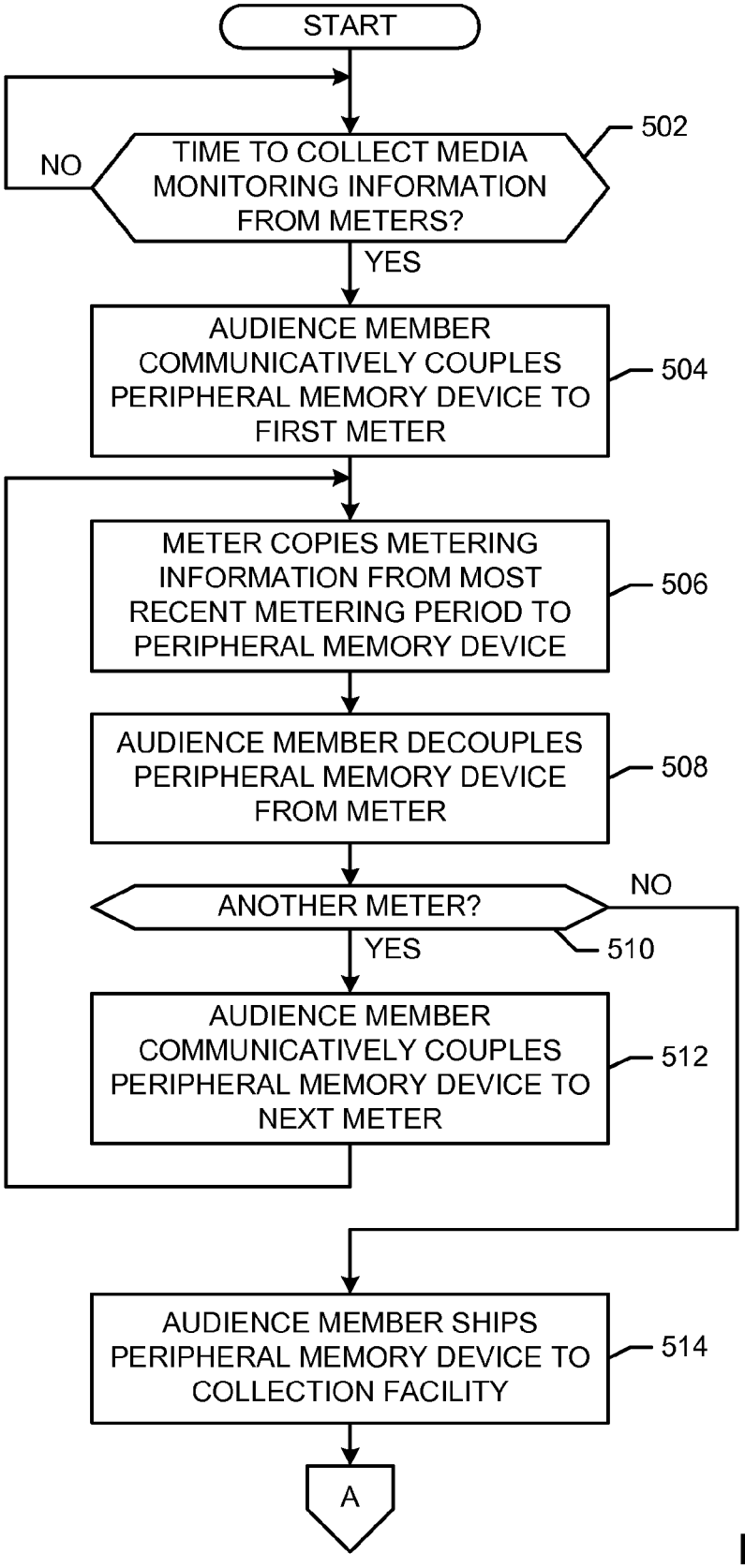
FIGS. 5A and 5B depict a flow diagram of an example method that may be used to collect media monitoring information generated by the example media meters of FIGS. 1, 2, and 4.
Figure 5B:
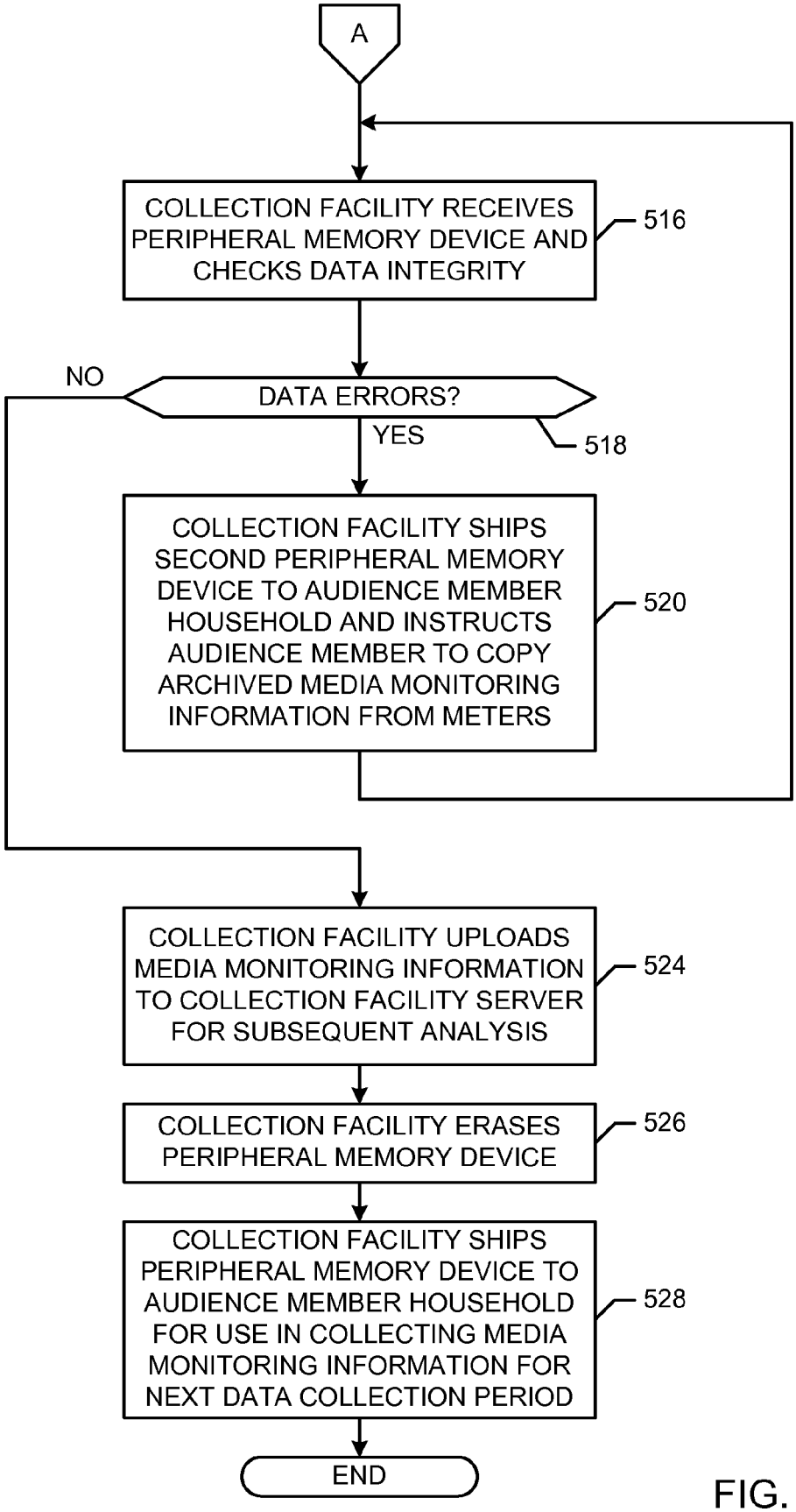
Figure 6:
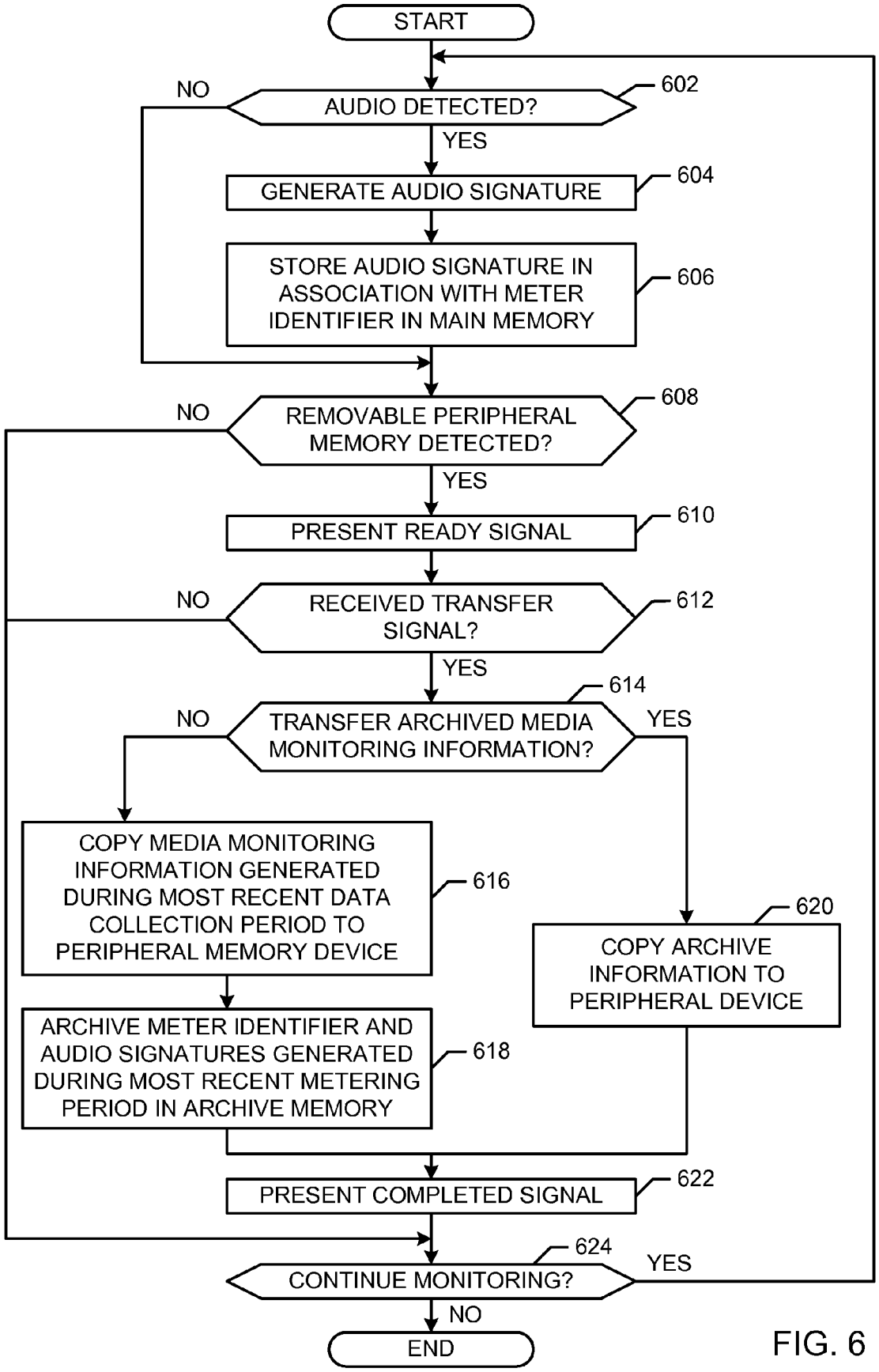
FIG. 6 depicts a flow diagram of an example method that may be used to generate media monitoring information and copy the media monitoring information from the media meters of FIGS. 1, 2 and 4 to the peripheral memory device of FIGS. 1-3.

FIGS. 5A, 5B, and 6 depict flow diagrams of example methods that may be used to implement the example methods and apparatus described herein. Some or all of the blocks of each the flow diagrams may be representative of machine readable instructions that may comprise one or more programs for execution by one or more processors (e.g., the processor 402 of FIG. 4 and/or the processor 712 of FIG. 7), one or more controllers, and/or any other suitable devices. The one or more programs may be embodied in software stored on a tangible medium such as, for example, the main memory 404 of FIG. 4 and/or one or both of the memories 724 and 725 of FIG. 7. Persons of ordinary skill in the art will readily appreciate that the entire program or programs and/or portions thereof could alternatively be executed by a device other than the processors 402 and 712 and/or may be embodied in firmware or dedicated hardware in any desired manner (e.g., implemented using an application specific integrated circuit (ASIC), a programmable logic device (PLD), a field programmable logic device (FPLD), discrete logic, etc.). Also, some or all of the operations of the flow diagrams of FIGS. 5A, 5B, and 6 may be implemented manually. Further, although the example methods are described with reference to the flow diagrams illustrated in FIGS. 5A, 5B, and 6, persons of ordinary skill in the art will readily appreciate that many other techniques for implementing the example methods and apparatus described herein may alternatively be used. For example, with reference to the flow diagrams illustrated in FIGS. 5A, 5B, and 6, the order of execution of the blocks may be changed, and/or some of the blocks described may be changed, eliminated, combined and/or subdivided into multiple blocks. In addition, some or all of the blocks may be presented as instructions by a media research company to an audience member.

Turning to FIGS. 5A and 5B, the illustrated flow diagram depicts an example method that may be used to collect media monitoring information (e.g., audio signatures, audio codes, timestamps, meter identifications, etc.) generated by the example media meters 106*a-c* of FIGS. 1, 2, and 4. Initially, the audience member 110 determines whether it is time to collect media monitoring information from the media meters 106*a-c* (block 502). For example, the times to collect the media monitoring information may be set to be once per data collection period (e.g., once per week, once per month, once every two months, etc.). In some example implementations, one or more of the media meters 106*a-c* may be configured to display a visual notification via a visual interface (e.g., the visual interface 414 of FIG. 4) when it is time to collect media monitoring information. If it is not time to collect media monitoring information, control remains at block 502 until it is time to collect media monitoring information.

When it is time to collect media monitoring information (block 502), the audience member 110 communicatively couples the peripheral memory device 108 to the first media meter 106*a* (block 504). The media meter 106*a* then copies the media monitoring information from the most recent metering period (i.e., the period that just ended) to the peripheral memory device 108 (block 506). An example method that may be used to implement the operation of block 506 is described below in connection with FIG. 6. When the media meter 106*a* has completed copying the media monitoring information to the peripheral memory device 108, the audience member 110 decouples the peripheral memory device 108 from the media meter 106*a* and determines whether there is another meter from which to collect media monitoring information (block 510). If there is another meter (block 510), the audience member 110 communicatively couples the peripheral memory device 108 to the next media meter (e.g., the media meter 106*b*) (block 512) and control returns to block 506 at the next meter.

If there is no other media meter from which to collect media monitoring information (block 510), the audience member 110 places the peripheral memory device 108 in the package 114 (FIGS. 1 and 2) and ships the package 114 having the peripheral memory device 108 to the collection facility 112 (FIG. 1) (block 514). The collection facility 112 receives the peripheral memory device 108 and checks data integrity of the media monitoring information stored on the peripheral memory device 108 (block 516) (FIG. 5B). If data errors exist (block 518), the collection facility 112 ships a second peripheral memory device to the audience member household 102 and instructs the audience member 110 to copy the archived media monitoring information from the media meters 106*a-c* (block 520). An example method that may be used to implement the operation of block 520 to copy the archived media monitoring information is described below in connection with FIG. 6. The collection facility 112 then receives the second peripheral device (block 516) and control returns to block 518 to determine whether data errors exist on the second peripheral memory device.

When no errors exist in the first or second peripheral device (block 518), the collection facility 112 uploads the media monitoring information from the peripheral memory device 108 to the collection facility server 118 (FIG. 1) for subsequent analysis (block 524). The collection facility 112 then erases the contents of the peripheral memory device 108 (block 526) and ships the peripheral memory device 108 back to the audience member household 102 for use in collecting media monitoring information for the next data collection period (block 528). The process of FIGS. 5A and 5B then ends.

FIG. 6 depicts a method, which may be implemented using machine readable instructions, that may be used to implement an example method to generate media monitoring information and copy the media monitoring information from the media meters 106*a-c* of FIGS. 1, 2 and 4 to the peripheral memory device 108 of FIGS. 1-3. For purposes of discussion, the flow diagram of FIG. 6 is described with respect to the media meter 106*c* of FIGS. 1, 2, and 4. Initially, the media meter 106*c* determines whether it has detected an audio emission (block 602) such as, for example, an audio emission from the media presentation device 104*c* (FIGS. 1 and 2). If the media meter 106*c* determines that it has detected an audio emission (block 602), the processor 402 of the media meter 106*c* generates an audio signature based on the detected audio emission (and/or collect an audio code from the audio emission) (block 604). The processor 402 then stores the audio signature (and/or the audio code) in the main memory 404 in association with a timestamp and a meter identifier of the meter 106*c* (block 606). For example, the processor 402 can generate the timestamp using the timing device 410 (FIG. 4). The processor 402 then determines if it has detected a connection of the peripheral memory device 108 (block 608). For example, when the meter interface 304 (FIG. 3) of the peripheral memory device 108 is coupled to the peripheral memory interface 408 of the media meter 106*c*, the peripheral memory interface 408 may send an interrupt to the processor 402. If the processor 402 has detected a connection of the peripheral memory device 108 (block 608), the visual interface 414 presents a ready indicator (block 610) indicating that the media meter 106*c* is ready to copy media monitoring information to the peripheral memory device 108.

The processor 402 then determines if it has received a transfer signal (block 612) to copy the media monitoring information. For example, when the audience member 110 presses a button on the input interface 416, the processor 402 can interpret the button press as a command to copy its media monitoring information to the peripheral memory device 108. If the processor 402 determines that it has received the transfer signal (block 612), the processor 402 determines whether the transfer signal is a request to transfer archived media monitoring information corresponding to a previous data collection cycle (block 614). For example, the input interface 416 may be provided with two buttons, one of which can be pressed by the audience member 110 to initiate a transfer of media monitoring information collected during the most recent data collection cycle and the other of which can be pressed by the audience member 110 to initiate a transfer of archived media monitoring information collected during a previous data collection cycle prior to the most recent one.

If the processor 402 determines that it is not to copy archived media monitoring information to the peripheral memory device 108 (block 614), the processor 402 copies the media monitoring information from the main memory 404 corresponding to the most recent data collection period to the peripheral memory device 108 (block 616) via the peripheral memory interface 408. The processor 402 then archives the media monitoring information corresponding to the most recent data collection period from the main memory 404 to the archive memory 406 (block 618). Referring back to block 614, if instead the processor 402 determines at block 614 that it is to copy archived media monitoring information to the peripheral memory device 108 (block 614), the processor 402 copies the archived media monitoring information from a prior data collection period from the archive memory 406 to the peripheral memory device 108 via the peripheral memory interface 408 (block 620).

After the processor 402 archives the media monitoring information at block 618 or copies the archived media monitoring information to the peripheral memory device 108 at block 620, the processor 402 presents a transfer complete signal (block 622) via the visual interface 414 indicating to the audience member 110 that the requested operation is complete. After the processor 402 presents the transfer complete signal (block 622) or if the processor 402 determines that it has not yet received an initiate data transfer signal (block 612) or if the processor 402 determines that it has not detected the connection of the peripheral memory device 108 (block 608), the processor 402 determines whether it should continue to monitor the audio emitted by the media presentation device 104*c* (block 624). If the processor 402 determines that it should continue to monitor, control returns to block 602. Otherwise, the process of FIG. 6 is ended.

Figure 7:
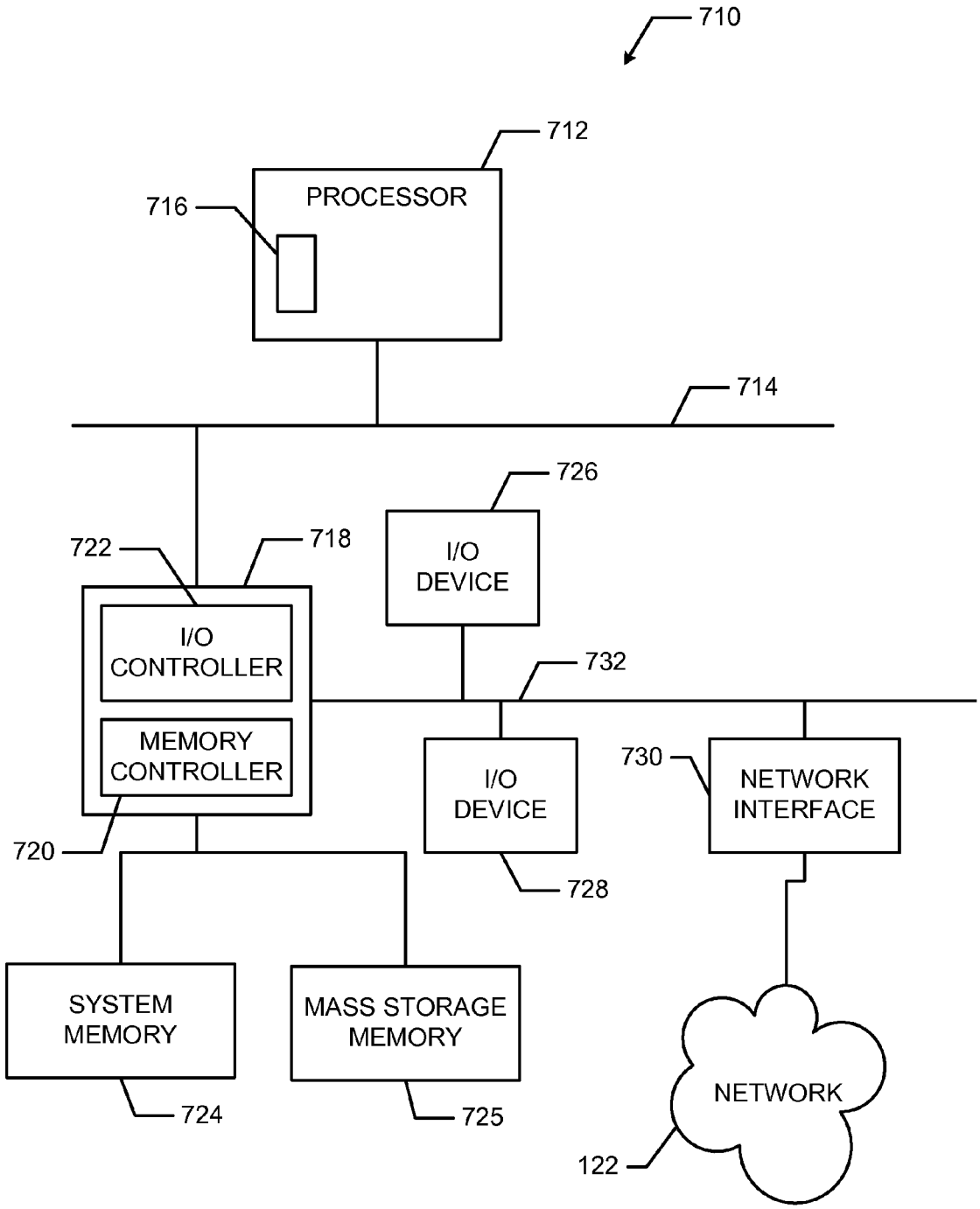
FIG. 7 is a block diagram of an example processor system that may be used to implement some or all of the example methods and apparatus described herein.

FIG. 7 is a block diagram of an example processor system 710 that may be used to implement the apparatus and methods described herein. For example, the processor system 710 may be used to implement the household computer 120, the collection facility server 118, or any of the media meters 106*a-c* of FIG. 1. As shown in FIG. 7, the processor system 710 includes a processor 712 that is coupled to an interconnection bus 714. The processor 712 includes a register set or register space 716, which is depicted in FIG. 7 as being entirely on-chip, but which could alternatively be located entirely or partially off-chip and directly coupled to the processor 712 via dedicated electrical connections and/or via the interconnection bus 714. The processor 712 may be any suitable processor, processing unit or microprocessor. Although not shown in FIG. 7, the system 710 may be a multi-processor system and, thus, may include one or more additional processors that are identical or similar to the processor 712 and that are communicatively coupled to the interconnection bus 714.

The processor 712 of FIG. 7 is coupled to a chipset 718, which includes a memory controller 720 and an input/output (I/O) controller 722. As is well known, a chipset typically provides I/O and memory management functions as well as a plurality of general purpose and/or special purpose registers, timers, etc. that are accessible or used by one or more processors coupled to the chipset 718. The memory controller 720 performs functions that enable the processor 712 (or processors if there are multiple processors) to access a system memory 724 and a mass storage memory 725.

The system memory 724 may include any desired type of volatile and/or non-volatile memory such as, for example, static random access memory (SRAM), dynamic random access memory (DRAM), flash memory, read-only memory (ROM), etc. The mass storage memory 725 may include any desired type of mass storage device including hard disk drives, optical drives, tape storage devices, etc.

The I/O controller 722 performs functions that enable the processor 712 to communicate with peripheral input/output (IO) devices 726 and 728 and a network interface 730 via an I/O bus 732. The I/O devices 726 and 728 may be any desired type of I/O device such as, for example, a keyboard, a video display or monitor, a mouse, etc. The network interface 730 is communicatively coupled to the network 124 and may be, for example, an Ethernet device, an asynchronous transfer mode (ATM) device, an 802.11 device, a DSL modem, a cable modem, a cellular modem, etc. that enables the processor system 710 to communicate with another processor system.

While the memory controller 720 and the I/O controller 722 are depicted in FIG. 7 as separate functional blocks within the chipset 718, the functions performed by these blocks may be integrated within a single semiconductor circuit or may be implemented using two or more separate integrated circuits.

Although certain methods, apparatus, systems, and articles of manufacture have been described herein, the scope of coverage of this patent is not limited thereto. To the contrary, this patent covers all methods, apparatus, systems, and articles of manufacture fairly falling within the scope of the appended claims either literally or under the doctrine of equivalents.

What is claimed is:

1. A system to collect metering information, the system comprising:

a first media meter to generate first media monitoring information in response to media presented by a first media presentation device during a first data collection period and to generate second media monitoring information in response to media presented by the first media presentation device during a second data collection period;

a main storage to store the first media monitoring information during the first data collection period and to store the second media monitoring information during the second data collection period;

an archive storage to store the first media monitoring information during the second data collection period;

a first peripheral memory device removably couplable by an audience member to the first media meter to receive at least one of the first media monitoring information or the second media monitoring information; and a second peripheral memory device removably couplable by the audience member to the first media meter to receive at least one of the first media monitoring information or the second media monitoring information, during the first data collection period, the first media monitoring information being receivable from the main storage, during the second data collection period, the first media monitoring information being receivable from the archive storage and the second media monitoring information being receivable from the main storage, and the second peripheral memory device to receive the first media monitoring information from the archive storage after the first media monitoring information has been determined to be corrupted on the first peripheral device.

2. A system as defined in claim 1, wherein the first media meter further comprises:

a processor to generate the first and second media monitoring information;

a meter interface to couple the meter to the peripheral memory device; and a meter timing device to generate timestamps.

3. A system as defined in claim 2, wherein the first peripheral memory device further includes a peripheral timing device to synchronize a timer of the peripheral memory device with the first media meter.

4. A system as defined in claim 1, wherein the first peripheral memory device includes a physical data interface.

5. A system as defined in claim 4, wherein the physical data interface includes a secure digital memory card interface, a multimedia card interface, a universal serial bus interface, or an IEEE 1394 interface.

6. A system as defined in claim 1, wherein the first media meter further comprises a visual interface to convey information to the audience member.

7. A system as defined in claim 1, wherein the first media meter further comprises an input interface to receive commands from the audience member.

8. A system as defined in claim 7, wherein the input interface further comprises a data transfer button to initiate transfer of at least one of the first or second media monitoring information between the first media meter and the first peripheral memory device.

9. A system as defined in claim 1, wherein the first media meter further comprises a transceiver to communicatively couple the first media meter to a computer.

10. A system as defined in claim 1, wherein the first peripheral memory device is removably couplable to a computer.

11. A system as defined in claim 1, further comprising a second media meter, wherein the first media meter and the second media meter correspond to first and second media presentation devices, respectively.

12. A system as defined in claim 11, wherein the first memory device is removably couplable to the second media meter.

13. A method of collecting media monitoring information, the method comprising:

instructing an audience member to couple a first peripheral memory device to a first media meter to retrieve media monitoring information collected during a first data collection period;

using a processor to transfer the media monitoring information from a main storage of the first media meter to the first peripheral memory device and to an archive storage of the first media meter;

instructing the audience member to remove the first peripheral memory device from the first media meter;

instructing the audience member to send the first peripheral memory device to a collection facility;

receiving the first peripheral memory device at a collection facility;

using a processor to verify integrity of the media monitoring information associated with the first peripheral memory device; and when the verification indicates an error in the media monitoring information on the first peripheral memory device, instructing the audience member to couple a second peripheral memory device to the first media meter to retrieve the media monitoring information from the archive storage.

14. A method as defined in claim 13, further comprising informing the audience member of a time to collect media monitoring information.

15. A method as defined in claim 13, wherein transferring the media monitoring information includes transferring one or more of a timestamp or a meter identification.

16. A method as defined in claim 13, wherein the first peripheral memory device is sent to the collection facility by sending the entire first peripheral memory device to the collection facility.

17. A method as defined in claim 13, further comprising:

instructing the audience member to removably couple a second peripheral memory device to the first media meter;

transferring the media monitoring information from the first media meter to the second peripheral memory device;

instructing the audience member to remove the second peripheral memory device from the first media meter; and instructing the audience member to send the second peripheral memory device to the collection facility.

18. A method as defined in claim 13, further comprising, prior to instructing the audience member to send the first peripheral memory device to the collection facility:

instructing the audience member to removably couple the first peripheral memory device to a second media meter;

transferring third media monitoring information from the second media meter to the first peripheral memory device; and instructing the audience member to remove the first peripheral memory device from the second media meter.

19. A method as defined in claim 18, wherein the first and second media meters correspond to first and second media presentation devices, respectively.

20. A method as defined in claim 13, further comprising uploading the media monitoring information to a collection facility server for analysis.

21. A method as defined in claim 20, further comprising:

erasing the media monitoring information associated with the first peripheral memory device; and sending at least one of the first or a second peripheral memory device to at least one of the first or a second audience member for use in collection of media monitoring information for a subsequent collection period.

22. A tangible machine-accessible medium excluding propagating signals and storing machine readable instructions that, when executed, cause a machine to at least:

detect a first signal;

generate a first signature in response to detecting the first signal;

store the first signature in a main storage during a first data collection period;

transfer the first signature from the main storage to an archive storage during a second data collection period;

detect a second signal;

generate a second signature in response to detecting the second signal;

store the second signature in the main storage during the second data collection period;

detect a first peripheral memory device;

transfer the first signature from the main storage to the first peripheral device upon receipt of a transfer signal after the first data collection period;

transfer the first signature from the archive storage to a second peripheral device upon receipt of a transfer signal after the second data collection period when the first signature has been determined to be corrupted on the first peripheral memory device;

transfer the second signature from the main storage to the second peripheral device upon receipt of a transfer signal after the second data collection period; and present a transfer completed signal.

23. An article of manufacture as defined in claim 22, wherein the detected signal is one or of an audio signal or a video signal.

24. An article of manufacture as defined in claim 22, wherein the generated signature is one of an audio signature or a video signature.

25. An article of manufacture as defined in claim 22 further including machine accessible instructions that, when executed, cause the machine to synchronize with the first peripheral memory device.

26. An article of manufacture as defined in claim 22 further including machine accessible instructions that, when executed, cause the machine to transfer one or more of a timestamp or a meter identification.

27. A method of collecting media monitoring information, the method comprising:

storing first media monitoring information in a main memory identifying media presented by a first media presentation device during a first data collection period;

generating second media monitoring information in the main storage identifying media presented by the first media presentation device during a second data collection period;

copying the first media monitoring information to an archive storage;

coupling a first peripheral memory device to a first media meter;

transferring the first media monitoring information from the main storage of the first media meter to the first peripheral memory device;

sending the first peripheral memory device to a collection facility;

transferring the first media monitoring information from the archive storage of the first media meter to a second peripheral memory device after the first media monitoring information or the first peripheral memory device is found to be corrupted; and sending the first peripheral memory device to the collection facility.

28. A method as defined in claim 27, further comprising determining a time to collect at least one of the first or second media monitoring information.

29. A method as defined in claim 27, wherein the first peripheral memory device is sent to the collection facility by sending the entire first peripheral memory device to the collection facility.

30. A method as defined in claim 27, further comprising, prior to sending the first peripheral memory device to the collection facility:

coupling the first peripheral memory device to a second media meter;

transferring third media monitoring information from the second media meter to the first peripheral memory device; and removing the first peripheral memory device from the second media meter.

31. A method as defined in claim 27, further comprising:

removing the second peripheral memory device from the first media meter; and sending the second peripheral memory device to the collection facility.

* * * * *